US005524583A

United States Patent [19]

Nishio

[11] Patent Number: 5,524,583

[45] Date of Patent: Jun. 11, 1996

[54] AIR SUCTION DEVICE FOR V-TYPE ENGINE

[75] Inventor: Yasuaki Nishio, Shizuoka-ken, Japan

[73] Assignee: Suzuki Motor Corporation, Shizuoka-ken, Japan

[21] Appl. No.: 442,479

[22] Filed: May 16, 1995

[30] Foreign Application Priority Data

Jul. 30, 1994 [JP] Japan ..... 6-197509

[51] Int. Cl.[6] ..... F02M 35/00

[52] U.S. Cl. ..... 123/184.34

[58] Field of Search ..... 123/184.31, 184.32, 123/184.33, 184.34, 184.35, 184.36, 184.37

[56] References Cited

U.S. PATENT DOCUMENTS

| | | | |
|---|---|---|---|
| 4,741,295 | 5/1988 | Hosoya et al. | 123/184.31 |
| 4,895,112 | 1/1990 | Rutschmann et al. | 123/184.31 |
| 5,156,117 | 10/1992 | Muller et al. | 123/184.31 |

FOREIGN PATENT DOCUMENTS

| | | |
|---|---|---|
| 2-59253 | 4/1990 | Japan . |
| 6-50224 | 2/1994 | Japan . |

*Primary Examiner* Marguerite McMahon
*Attorney, Agent, or Firm* Flynn, Thiel, Boutell & Tanis

[57] ABSTRACT

An air suction device for a V-type engine whereby primary and secondary side intake manifolds having other component assembled thereon is built into the V-type engine without dividing the manifolds. Each flange end portion of the primary side manifold-mounting flange is tightened to a primary side cylinder head by respective ones of primary side fasteners, whereas each flange end portion of the secondary side manifold-mounting flange is fastened to a secondary side cylinder head by respective ones of secondary side fasteners. On at least one side of the engine, the fasteners for respectively securing the flange end portions are located in an outward direction of the engine with respect to a port entrance centerline, which interconnects the centers of port entrance portions of the one side of the engine.

4 Claims, 7 Drawing Sheets

AIR SUCTION DEVICE FOR V-TYPE ENGINE

FIELD OF THE INVENTION

This invention relates to an air suction device for a V-type combustion engine. More particularly, it relates to an improved air suction device for a V-type engine in which intake manifolds having other components assembled thereon can be mounted, as such, on cylinder heads without being divided.

BACKGROUND OF THE INVENTION

Vehicular engines are classed as an engine having cylinders arranged in series, an engine having cylinders positioned to oppose each other, a V-type engine having cylinders arranged in a V-shaped configuration, and the like.

Among the V-type engines, there is one type of engine in which primary and secondary side cylinder heads are placed respectively on primary and secondary side cylinder banks, thereby forming primary and secondary side engine banks. The cylinder banks are upper leg portions of a V-shaped cylinder block. In this engine, a primary side manifold-mounting flange for a primary side intake manifold is tightened to the primary side cylinder head by a plurality of primary side fasteners. The above intake manifold is provided with a plurality of primary side branch pipes for introducing inducted air into primary side cylinders of the primary side engine bank. A secondary side manifold-mounting flange for a secondary side intake manifold is secured to the secondary side cylinder head by a plurality of secondary side fasteners. The secondary side intake manifold is provided with a plurality of secondary side branch pipes for introducing inducted air into secondary side cylinders of the secondary side engine bank.

More specifically, a V-type engine 102 as illustrated in FIG. 7 is a multi-cylinder engine which includes, e.g., six cylinders. The engine 102 has primary and secondary side engine banks 104 and 106, respectively. The engine bank 104 is provided with three primary side cylinders (not shown). The engine bank 106 is provided with three secondary side cylinders (not shown). In addition, there is a V-shaped bank space 108 formed between the engine banks 104 and 106.

A primary side surge tank 112 is positioned above the secondary side engine bank 106. The surge tank 112 is formed in a primary side intake manifold 110. The surge tank 112 has the following branch pipes of the intake manifold 110 arranged in a side-by-side array: a primary side first branch pipe 114-1; a primary side second branch pipe 114-2; and, a primary side third branch pipe 114-3. The branch pipes 114-1 through 114-3 are connected at ones of distal ends thereof to a primary side manifold-mounting flange 116. There are primary side intake ports (not shown) which have the following portions formed at an upper portion of a primary side cylinder head (not shown): a primary side first port entrance portion 118-1; a primary side second port entrance portion 118-2; and, a primary side third port entrance portion 118-3. The above-mentioned flange 116 is located on the port entrance portions 118-1 through 118-3.

The flange 116, which extends along the port entrance portions 118-1 through 118-3, is fixedly attached to the primary side cylinder head by being fastened in a manner mentioned below. That is, the flange 116 is secured by: a primary side first fastener 122-1 at a primary side first flange end portion 120-1 on the first port entrance portion 118-1, the fastener 122-1 including a bolt and the like; a primary side second fastener 122-2 near the second port entrance portion 118-2; a primary side third fastener 122-3 near the third port entrance portion 118-3; and, a primary side fourth fastener 122-4 at a primary side second flange end portion 120-2 which continuously extends from a primary side communication portion 124 on the side of the third port entrance portion 118-3.

As illustrated in FIGS. 7 and 8, the aforesaid fasteners 122-1 through 122-4 are situated on a primary side port entrance centerline LC. The centerline LC interconnects respective centers of the port entrance portions 118-1 through 118-3, i.e., $LO_1$ for primary side first center, $LO_2$ for primary side second center, and $LO_3$ for primary side third center.

A secondary side surge tank 128 is positioned above the primary side engine bank 104. The surge tank 128 is formed in a secondary side intake manifold 126. The surge tank 128 has the following branch pipes of the intake manifold 126 arranged in a side-by-side array: a secondary side first branch pipe 130-1; a secondary side second branch pipe 130-2; and, a secondary side third branch pipe 130-3. The branch pipes 130-1 through 130-3 are connected at ones of distal ends thereof to a secondary side manifold-mounting flange 132. There are secondary side intake ports (not shown) which have the following portions formed at an upper portion of a secondary side cylinder head (not shown): a secondary side first port entrance portion 134-1; a secondary side second port entrance portion 134-2; and, a secondary side third port entrance portion 134-3. The above-mentioned flange 132 is located on the above port entrance portions 134-1 through 134-3.

The flange 132, which extends along the port entrance portions 134-1 through 134-3, is fixedly attached to the secondary side cylinder head by being fastened in a manner described below. That is, the flange 132 is secured by: a secondary side first fastener 140-1 at a secondary side first flange end portion 138-1 which continuously extends from a secondary side communication portion 136 on the side of the first portion entrance portion 134-1, the first fastener 140-1 including a bolt and the like; a secondary side second fastener 140-2 near the first port entrance portion 134-1; a secondary side third fastener 140-3 near the second port entrance portion 134-2; and, a secondary side fourth fastener 140-4 at a secondary side second flange end portion 138-2 adjacent to the third port entrance portion 134-3.

As illustrated in FIGS. 7 and 8, the aforesaid fasteners 140-1 through 140-4 are located on secondary side port entrance centerline RC. The centerline RC interconnects respective centers of the port entrance portions 134-1 through 134-3, i.e., $RO_1$ for secondary side first center, $RO_2$ for secondary side second center, and $RO_3$ for secondary side third center.

In this way, the flanges 116 and 132 are tightened respectively by the four primary side fasteners 122 and the four secondary side fasteners 140, all of which fasteners are linearly arranged along the respective centerline LC and RC. This is intended to both reduce the number of fasteners and insure sealing performance because the bank space 108 provides a low degree of freedom in the fastening of the two side intake manifolds 110 and 126.

A primary side distribution pipe 142 is connected at one end to the primary side surge tank 112. The other end of the pipe 142 is connected to a body side collection pipe 146 which continuously extends from a throttle body 144.

A secondary side distribution pipe 148 is connected at one end to the secondary side surge tank 128. The other end of the pipe 148 is connected to the body side collection pipe 146.

As shown in FIG. 7, the throttle body 144 is disposed at one end portion of the engine 102 within the bank space 108.

In addition, a thermo-case 150 is positioned at the other end portion of the engine 102 within the bank space 108.

Such an air suction device for a V-type combustion engine is disclosed in, e.g., published Japanese Utility Model Application Laid-Open No. 2-59253 and published Japanese Patent Application Laid-Open No. 6-50224. According to the former publication, right and left branch pipes for respectively distributing inducted air into right and left engine banks and two collectors for respectively collecting the right and left branch pipes are formed integrally. In addition, the branch pipes are integrally connected together at midway portions thereof. The collectors are fitted with respective throttle valves at entrance portions thereof. According to the latter publication, there are one intake pipe and another. The former pipe interconnects a surge tank on one side and a cylinder on the other side, while the latter pipe interconnects a surge tank on the other side and a cylinder on one side. These two pipes are alternately arranged to avoid an overlap on a plane, whereby the intake pipes are formed integrally as an intake pipe body. This body is provided with respective portions for mounting delivery pipes for supplying fuel to the downstream sides of the intake pipes. Further, head-fastening portions are provided adjacent to a downstream end of the intake pipe body. The fastening portions serve to fix the respective intake pipes to one cylinder head on one side and another on the other side. With continued reference to the above Japanese Patent Application Laid-Open No. 6-50224, tightening as illustrated in FIG. 9 is provided in order to improve sealing performance. In greater detail, the flange 116 is tightened by: two primary side second fasteners 122-2 near the primary side second port entrance portion 118-2, the fasteners 122-2 being symmetrically positioned on opposite sides of the primary side port entrance centerline LC; and, two primary side third fasteners 122-3 near the third port entrance portion 118-3, the fasteners 122-3 being symmetrically positioned on opposite sides of the centerline LC. Further, the flange 132 is secured by: two secondary side second fasteners 140-2 near the secondary side first port entrance portion 134-1, the fasteners 140-2 being symmetrically positioned on opposite sides of the secondary side port entrance centerline RC; and, two secondary side third fasteners 140-3 near the third port entrance portion 134-3, the fasteners 140-3 being symmetrically positioned on opposite sides of the centerline RC.

In conventional air suction devices for V-type combustion engines, a problem arises when components such as a throttle body and an ISC valve (an idle speed control valve) need to be assembled onto primary and secondary side intake manifolds. To be specific, when a component such as the throttle body is disposed within a bank space between primary and secondary side engine banks, respective locations for primary and secondary side fasteners to be secured thereat are hidden from view. In greater detail, when primary and secondary side manifold-mounting flanges are positioned adjacent to primary and secondary side port entrance centerlines, the above flanges lie near the longitudinal axis of the V-type engine. As a result, the flanges are hidden by the component such as the throttle body (such as body 144 as designated by slanted lines in FIG. 7). Consequently, the assembly of the mounting flanges is difficult to achieve. This results in an inconvenience in that the above two side intake manifolds must be respectively divided, with concomitant increases in both assembly time and cost.

Further, as shown in FIG. 7, a thermo-case 150 is disposed under the intake manifolds within the bank space 108. In addition, piping is provided at one end portion of the V-type engine. In this case, a thermo-case system must be laid out in a small gap between a chain case (a timing belt cover) and the intake manifolds. As a result, the gap under the intake manifolds is made extremely small when the flanges on both sides are tightened at positions adjacent to respective centerlines of the primary and secondary side port entrances. This causes an inconvenience by reducing the degree of freedom in the layout of the thermo-case system.

To eliminate the aforesaid inconveniences, the present invention provides an air suction device for a V-type engine, having primary and secondary side engine banks formed by primary and secondary side cylinder heads placed respectively on primary and secondary side cylinder banks, the cylinder banks being upper portions of a V-shaped cylinder block, in which a primary side manifold-mounting flange for a primary side intake manifold is tightened to the primary side cylinder head by a plurality of primary side fasteners, the primary side intake manifold being provided with a plurality of primary side branch pipes for introducing inducted air into primary side cylinders of the primary side engine bank, and in which a secondary side manifold-mounting flange for a secondary side intake manifold is secured to the secondary side cylinder head by a plurality of secondary side fasteners, the secondary side intake manifold being provided with a plurality of secondary side branch pipes for introducing inducted air into secondary side cylinders of the secondary side engine bank, the improvement wherein each end portion of the primary side flange is secured to the primary side cylinder head by a respective one of the primary side fasteners, whereas each end portion of the secondary side flange is fastened to the secondary side cylinder head by a respective one of the secondary side fasteners, and wherein at least one side of the primary and secondary side fasteners for respectively tightening the primary and secondary side flange end portions is disposed in an outward direction of the engine in relation to a respective port entrance centerline which interconnects respective centers of port entrance portions of the primary and secondary side intake ports, the intake ports being in respective communication with the primary and secondary side cylinders.

According to the present invention, the end portions of the primary and secondary flanges on both sides are positioned in the outward direction of the V-type engine with respect to the primary and secondary side port entrance centerlines. This arrangement enables the primary and secondary side intake manifolds having a throttle body and the like assembled thereon to be built into the V-type engine at a time without respectively dividing the intake manifolds. This feature allows for reductions in both assembly time and cost. Furthermore, components such as a thermo-case can be laid out with a greater amount of freedom. In addition, it is possible to reduce the likelihood that small components fall out and enter the bank space between the primary and secondary side engine banks.

DETAILED DESCRIPTION

Figure 1:
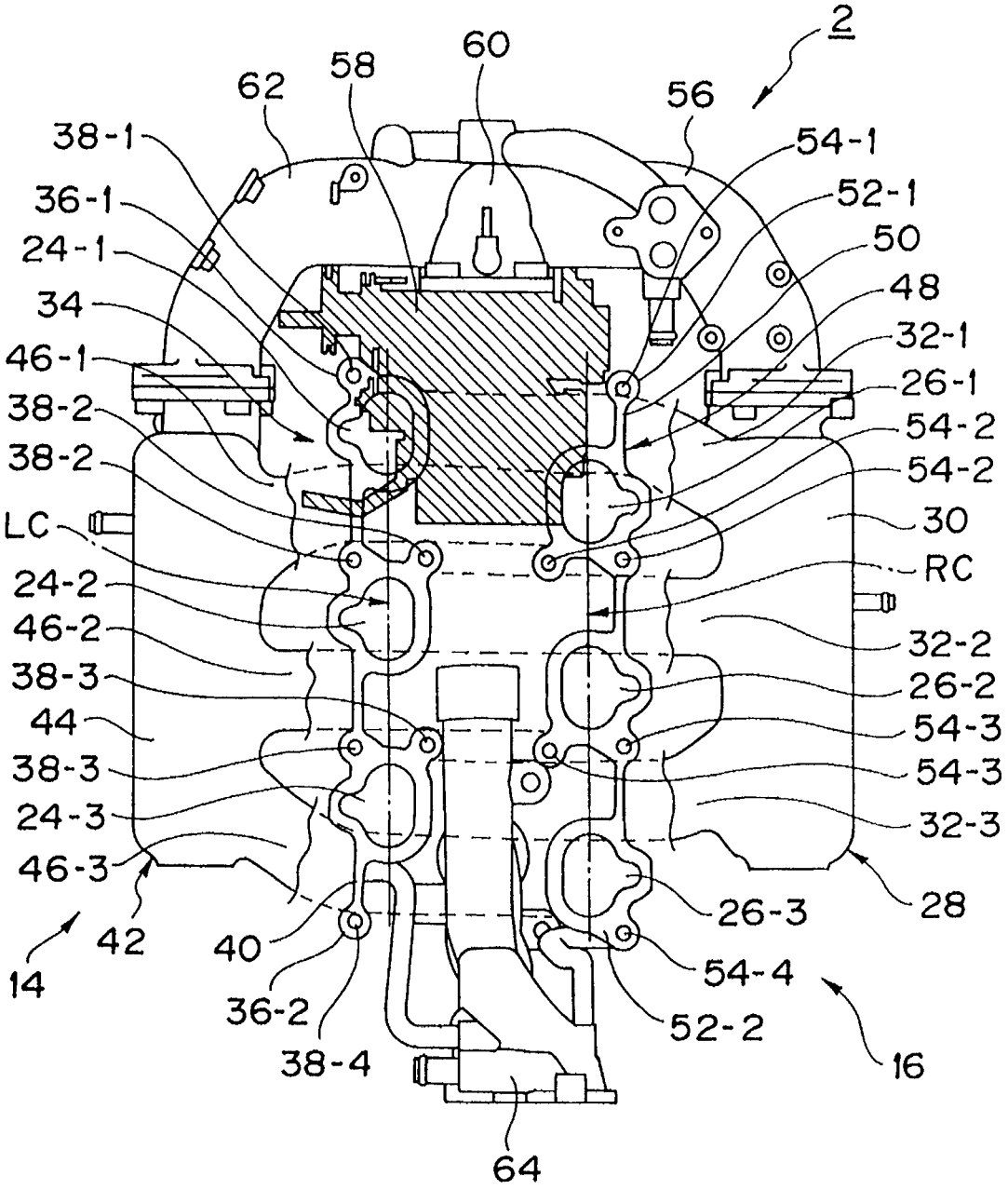
FIG. 1 is a partially broken plan view depicting a V-type engine.

Embodiments of the present invention will now be described in specific detail with reference to the drawings. FIGS. 1–4 illustrate one embodiment. In FIGS. 1, 3, and 4, reference numeral 2 denotes a V-type multi-cylinder combustion engine which includes, e.g., six cylinders. The engine 2 has primary and secondary side engine banks 14 and 16 which are formed by primary and secondary side cylinder heads 10 and 12 placed respectively on primary and secondary side cylinder banks 6 and 8. The cylinder banks 6 and 8 are respective upper portions of a V-shaped cylinder block 4. A primary side cylinder head cover 18 is mounted on the cylinder head 10. In addition, a secondary side cylinder head cover 20 is firmly attached to the cylinder head 12.

There is a V-shaped bank space 22 defined between the engine banks 14 and 16.

The engine bank 14 has three primary side cylinders (not shown) arranged in series. The engine bank 16 has three secondary side cylinders (not shown) arranged in series.

The primary side cylinders communicate with respective primary side intake ports (not shown) which have the following portions formed in position at an upper portion of the cylinder head 10: a primary side first port entrance portion 24-1; a primary side second port entrance portion 24-2; and, a primary side third port entrance portion 24-3.

The secondary side cylinders communicate with respective secondary side intake ports (not shown) which have the following portions formed in position at an upper portion of the cylinder head 12: a secondary side first port entrance portion 26-1; a secondary side second port entrance portion 26-2; and, a secondary side third port entrance portion 26-3.

A primary side surge tank 30 is disposed above the secondary side engine bank 16. The surge tank 30 is formed in a primary side intake manifold 28. The surge tank 30 has the following branch pipes of the intake manifold 28 arranged in a side-by-side array: a primary side first branch pipe 32-1; a primary side second branch pipe 32-2; and, a primary side third branch pipe 32-3. The branch pipes 32-1 through 32-3 are connected at ones of distal ends thereof to a primary side manifold-mounting flange 34. The flange 34 is located on the aforesaid primary side port entrance portions 24-1, 24-2, and 24-3.

The flange 34, which extends along the port entrance portions 24-1 through 24-3, is fixedly attached to the primary side cylinder head 10 by being tightened in a manner mentioned below. That is, the flange 34 is fastened by a primary side first fastener 38-1 at a primary side first flange end portion 36-1 on the first port entrance portion 24-1. The first flange end portion 36-1 is displaced by distance D (FIG. 2) in the outward (i.e. sideward) direction of the engine 2 from primary side port entrance centerline LC. The centerline LC interconnects respective centers of the port entrance portions 24-1 through 24-3, i.e., $LO_1$ for primary side first center, $LO_2$ for primary side second center, and $LO_3$ for primary side third center. The first fastener 38-1 includes a bolt and the like. Further, the flange 34 is fastened by two primary side second fasteners 38-2 near the second port entrance portion 24-2. The second fasteners 38-2 are symmetrically positioned on opposite sides of the centerline LC. In addition, the flange 34 is secured by two primary side third fasteners 38-3 near the third port entrance portion 24-3. The third fasteners 38-3 are symmetrically positioned on opposite sides of the centerline LC. Yet further, the flange 34 is fastened by a primary side fourth fastener 38-4 at a primary side second flange end portion 36-2. The second flange end portion 36-2 continuously extends from a primary side communication portion 40 on the side of the third port entrance portion 24-3, and is displaced by distance D in the outward (i.e. sideward) direction of the engine 2 from the centerline LC.

In brief, the following primary side fasteners are spaced apart from the centerline LC by distance D in the outward direction of the engine 2: the first fastener 38-1 for tightening the flange 34 at the first flange end portion 36-1; an outer one of the second fasteners 38-2 for tightening the flange 34 in the vicinity of the second port entrance portion 24-2; an outer one of the third fasteners 38-3 for securing the flange 34 in the vicinity of the third port entrance portion 24-3; and, the fourth fastener 34-4 for securing the flange 34 at the second flange end portion 36-2. In the meantime, the other of the second fasteners 38-2 and the other of the third fasteners 38-3 are disposed in the inward direction of the engine 2 by distance E from the centerline LC.

A secondary side surge tank 44 is positioned above the primary side engine bank 14. The surge tank 44 is formed in a secondary side intake manifold 42. The surge tank 44 has the following branch pipes of the intake manifold 42 arranged in a side-by-side array: a secondary side first branch pipe 46-1; a secondary side second branch pipe 46-2; and, a secondary side third branch pipe 46-3. The branch pipes 46-1 through 46-3 are connected at ones of distal ends thereof to a secondary side manifold-mounting flange 48. The flange 48 is located on the previously mentioned secondary side port entrance portions 26-1, 26-2, and 26-3.

The flange 48, which extends along the port entrance portions 26-1 through 26-3, is fixedly attached to the secondary side cylinder head 12 by being tightened in a manner described below. That is, the flange 48 is fastened by a secondary side first fastener 54-1 at a secondary side first flange end portion 52-1. The first flange end portion 52-1 continuously extends from a secondary side communication portion 50 on the side of the first port entrance portion 26-1, and is displaced by distance D (FIG. 2) in the outward (i.e. sideward) direction of the engine 2 from secondary side port entrance centerline RC. The centerline RC interconnects respective centers of the port entrance portions 26-1 through 26-3, i.e., $RO_1$ for secondary side first center, $RO_2$ for secondary side second center, and $RO_3$ for secondary side third center. The first fastener 54-1 includes a bolt and the like. Further, the flange 48 is fastened by two secondary side second fasteners 54-2 near the first port entrance portion 26-1. The second fasteners 54-2 are symmetrically positioned on opposite sides of the centerline RC. In addition, the flange 48 is secured by two secondary side third fasteners 54-3 near the third port entrance portion 26-3. The third fasteners 54-3 are symmetrically positioned on opposite sides of the centerline RC. Yet further, the flange 48 is fastened by a secondary side fourth fastener 54-4 at a secondary side second flange end portion 52-2 on the third port entrance portion 26-3. The second flange end portion 52-2 is displaced by distance D in the outward direction of the engine 2 from the centerline RC.

In brief, the following secondary side fasteners are spaced apart from the centerline RC by distance D in the outward sideward direction of the engine 2: the first fastener 54-1 for tightening the flange 48 at the first flange end portion 52-1; an outer one of the second fastener 54-2 for tightening the flange 48 in the vicinity of the first port entrance portion 26-1; an outer one of the third fasteners 54-3 for securing the flange 48 in the vicinity of the third port entrance portion 26-3; and, the fourth fastener 54-4 for securing the flange 48 at the second flange end portion 52-2. In the meantime, the other of the second fasteners 54-2 and the other of the third fasteners 54-3 are disposed in the inward sideward direction of the engine 2 by distance E from the centerline RC.

A primary side distribution pipe 56 is connected at one end to the primary side surge tank 30. The other end of the pipe 56 is connected to a body side collection pipe 60 which continuously extends from a throttle body 58.

A secondary side distribution pipe 62 is connected at one end to the secondary side surge tank 44. The other end of the pipe 62 is connected to the body side collection pipe 60.

As shown in FIGS. 1 and 3, the throttle body 58 is disposed at one end portion of the engine 2 within the bank space (i.e. space 22 in FIG. 4) between the primary and secondary side engine banks 14 and 16.

In addition, a thermo-case 64 is disposed at the other end portion of the engine 2 within the bank space 22.

Further, as illustrated in FIG. 3, there are primary and secondary side delivery pipes 66 and 68 within the bank space 22. The primary side delivery pipe 66 is positioned on the port entrance portions 24-1 through 24-3. The secondary side delivery pipe 68 is located on the port entrance portions 26-1 through 26-3.

The delivery pipe 66 is connected to: a primary side first fuel injection valve 70-1; a primary side second fuel injection valve 70-2; and, a primary side third fuel injection valve 70-3. These valves are attached to the primary side cylinder head 10 adjacent to the port entrance portions 24-1, 24-2, and 24-3. The delivery pipe 68 is connected to: a secondary side first fuel injection valve 72-1; a secondary side second fuel injection valve 72-2; and, a secondary side third fuel injection valve 72-3. There valves are attached to the secondary side cylinder head 12 adjacent to the port entrance portions 26-1, 26-2, and 26-3.

The operation of the embodiment of FIGS. 1–4 will now be described.

Figure 2:
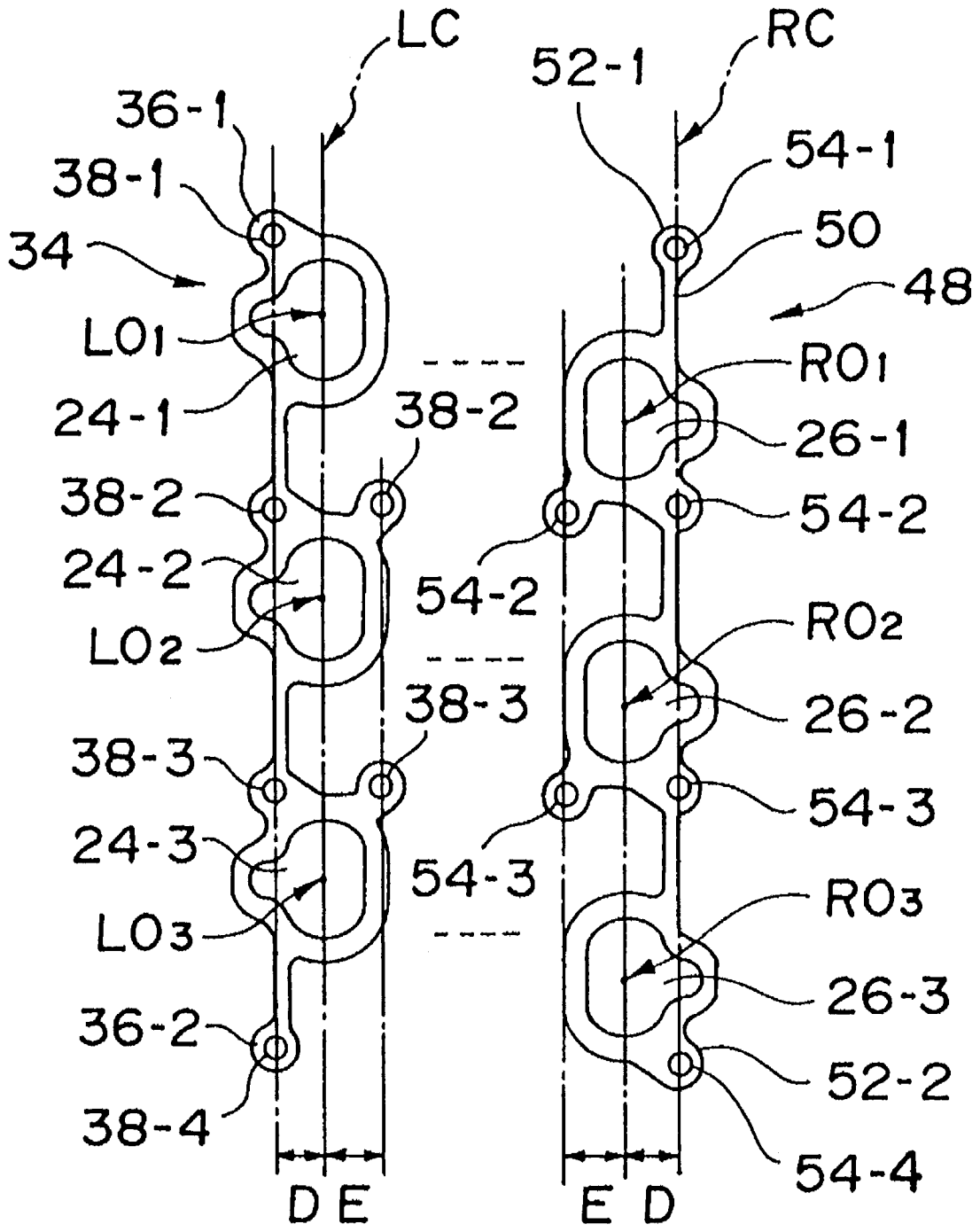
FIG. 2 is a plan view showing primary and secondary side manifold-mounting flanges.
Figure 3:
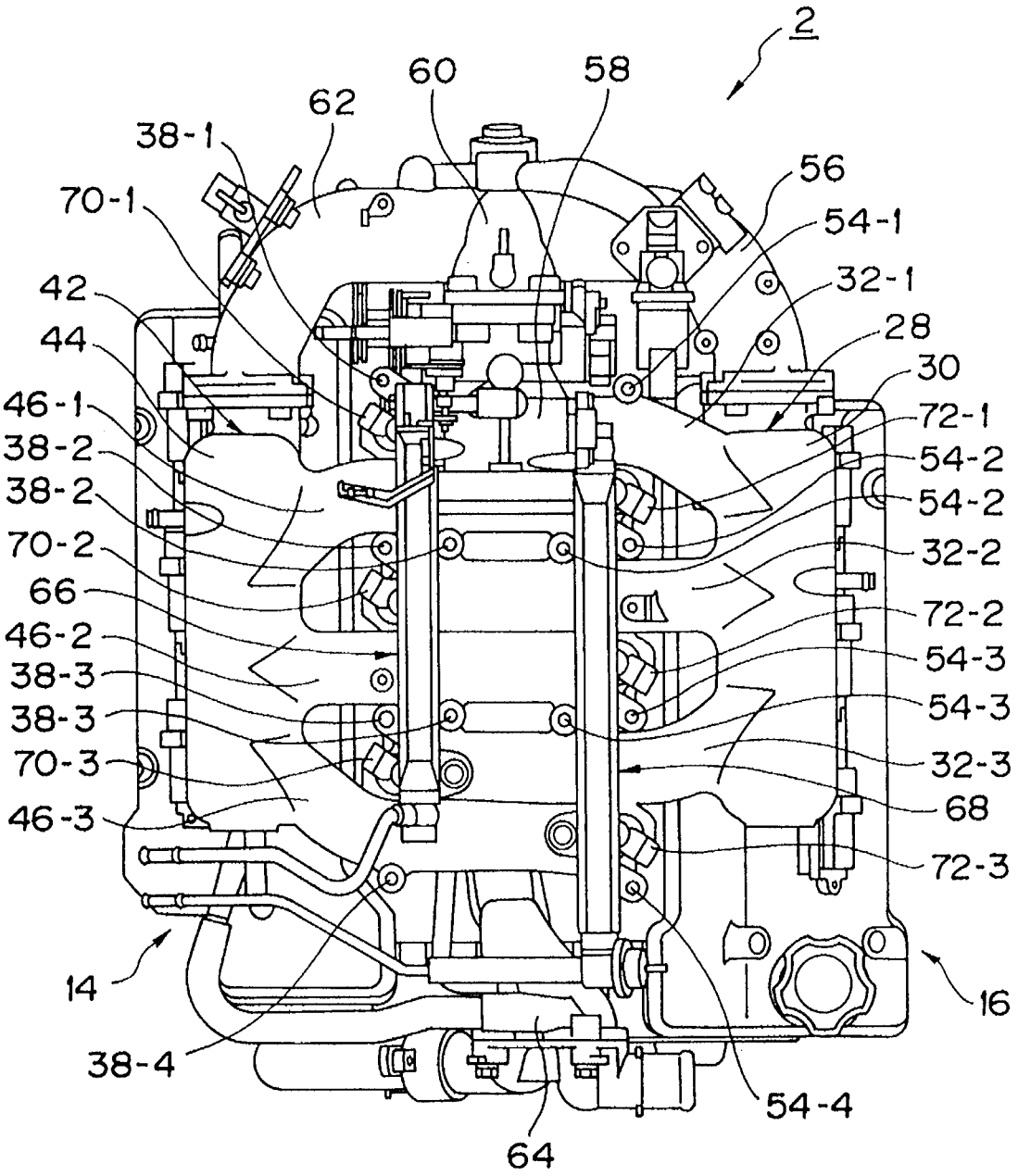
FIG. 3 is a plan view illustrating the V-type engine.
Figure 4:
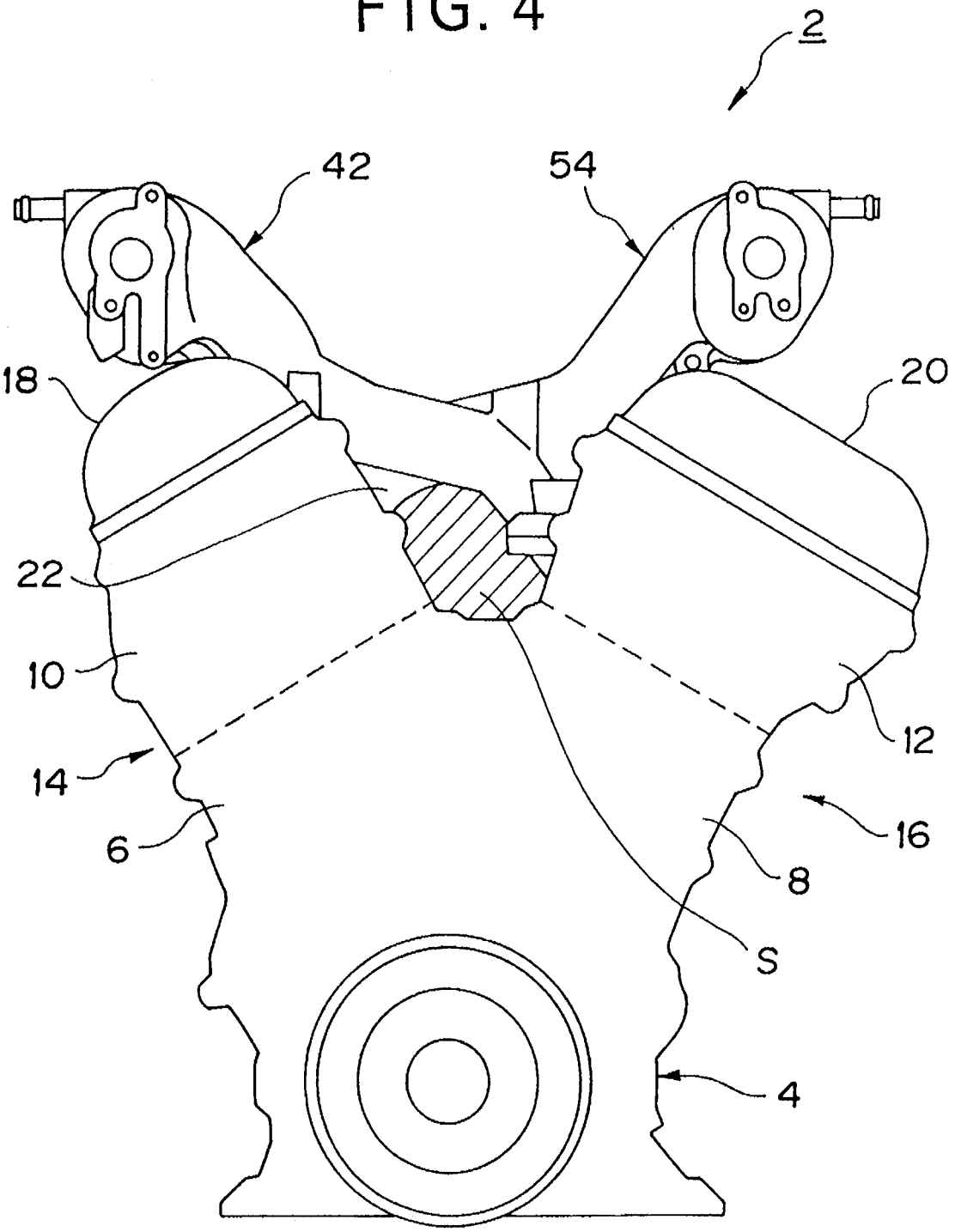
FIG. 4 is a front view showing the V-type engine.

As illustrated in FIGS. 1, 2 and 3, first and second flange end portions 36-1 and 36-2 of primary side manifold-mounting flange 34 are situated in an outward direction relative to: a primary side first port entrance portion 24-1; a primary side second port entrance portion 24-2; and, a primary side third port entrance portion 24-3. In addition, first and second flange end portions 52-1 and 52-2 of secondary side manifold-mounting flange 48 lie in the outward direction relative to: a secondary side first port entrance portion 26-1; a secondary side second port entrance portion 26-2; and, a secondary side third port entrance portion 26-3. This arrangement allows the primary and secondary side flanges 34 and 48 to be easily tightened onto primary and secondary side cylinder heads 10 and 12 from the top, as needed, even when any component such as a throttle body 58 remains assembled on the intake manifolds 28 and 42. As a result, there is no need for respectively dividing the manifolds 28 and 42. This feature enables reductions in both assembly time and cost.

Furthermore, as shown in FIG. 3, even when a thermo-case 64 is disposed below the intake manifolds 28 and 42, there is provided an enlarged gap or space S below and between the second flange end portions 36-2 and 52-2 (which space is designated by slanted lines in FIG. 4). This provides a greater amount of freedom in the layout of the system of the thermo-case 64.

Moreover, easy tightening of the flanges 34 and 48 is achievable, even when primary and secondary side fuel delivery pipes 66 and 68 are disposed respectively on primary and secondary side port entrance centerlines LC and RC, as illustrated in FIG. 3.

Yet further, the intake manifolds 28 and 42, which have respective sub-assemblies built thereon, are mounted on the V-type engine 2. Consequently, it is possible to reduce the likelihood that small components such as bolts fall out and enter the bank space 22.

Figure 5:
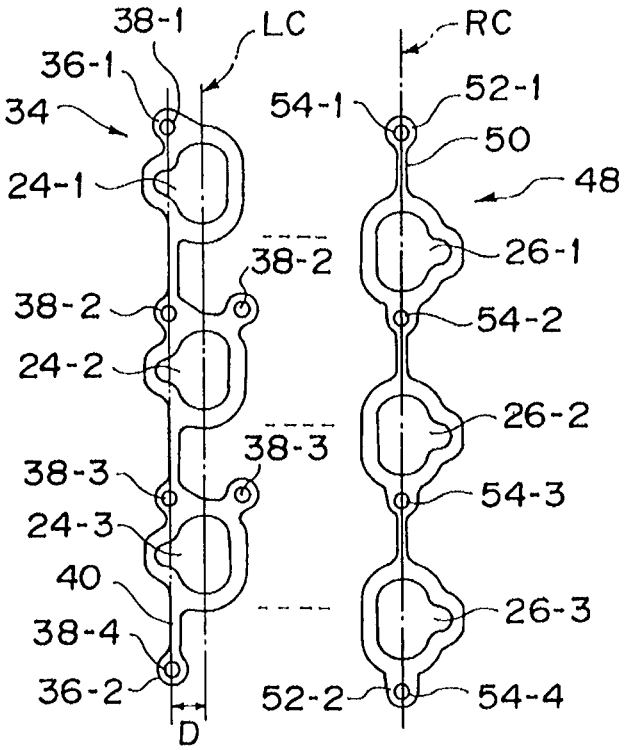
FIG. 5 is a plan view showing primary and secondary side manifold-mounting flanges according to another embodiment.
Figure 6:
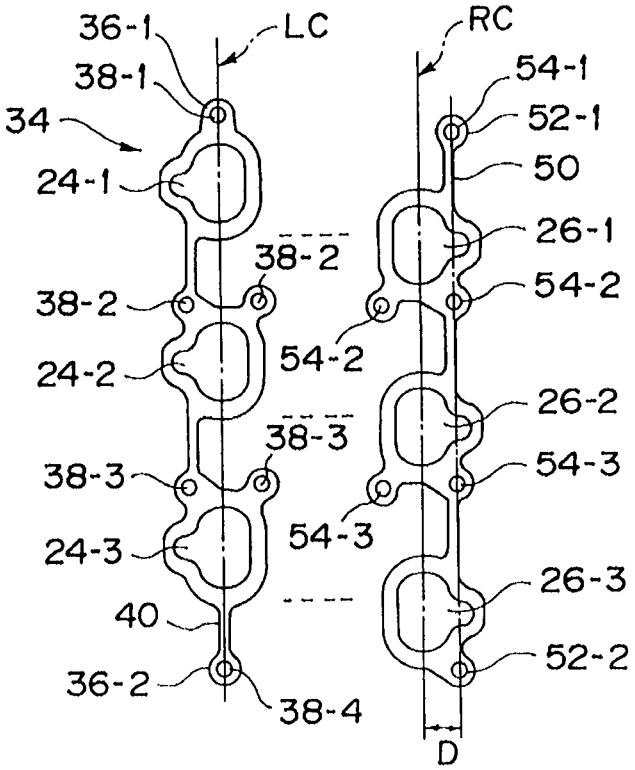
FIG. 6 is a plan view showing primary and secondary side manifold-mounting flanges according to yet another embodiment.
Figure 7:
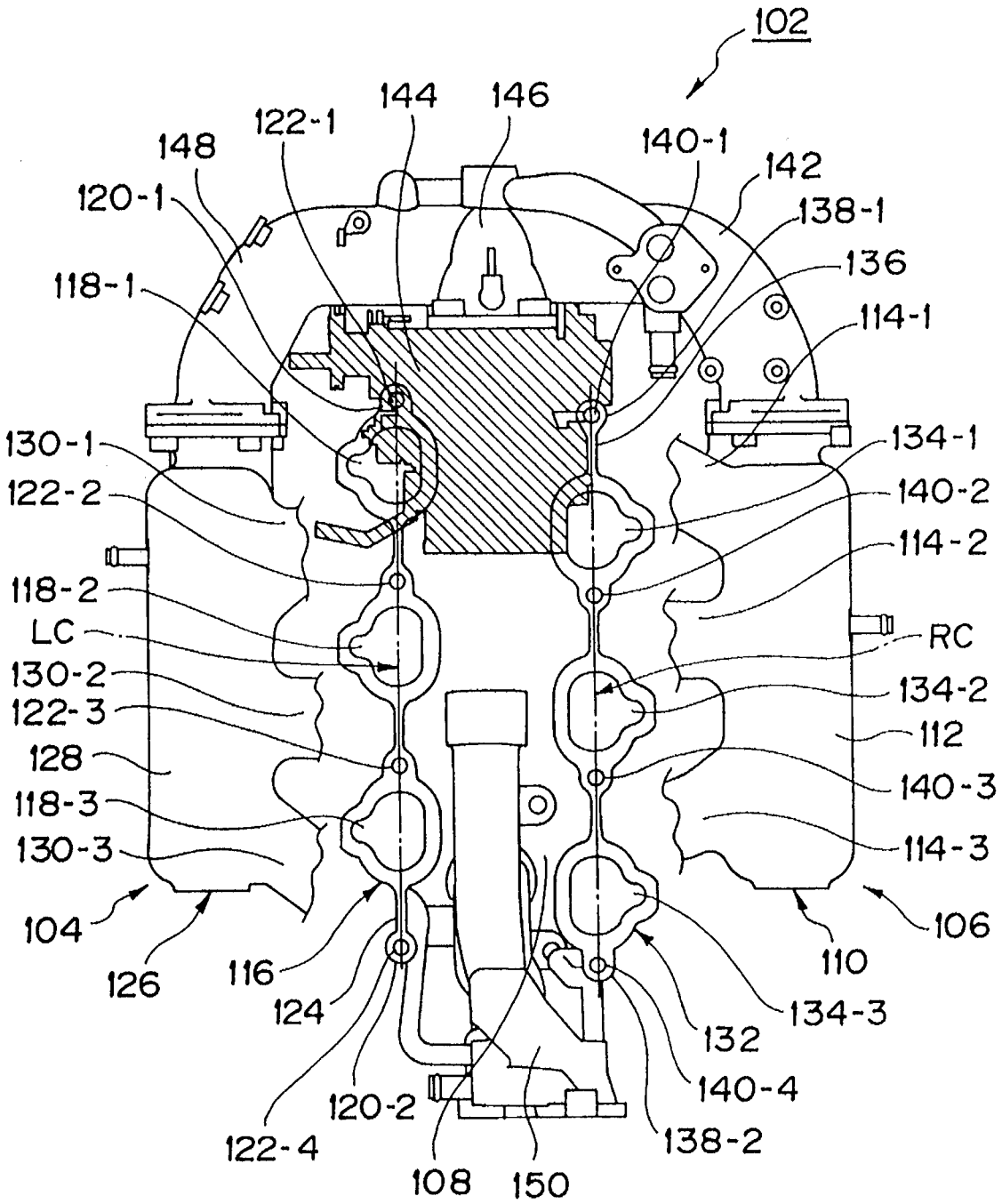
FIG. 7 PRIOR ART
FIG. 7 is a partially broken plan view illustrating a conventional V-type engine.
Figure 8:
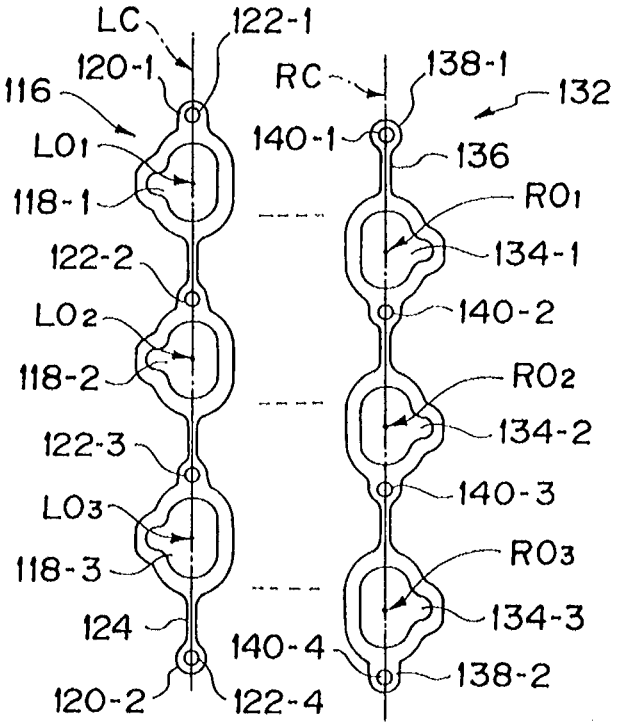
FIG. 8 PRIOR ART
FIG. 8 is a plan view illustrating a conventional example of primary and secondary side manifold-mounting flanges; and, FIG. 9 is a plan view illustrating another conventional example of primary and secondary side manifold-mounting flanges.
Figure 9:
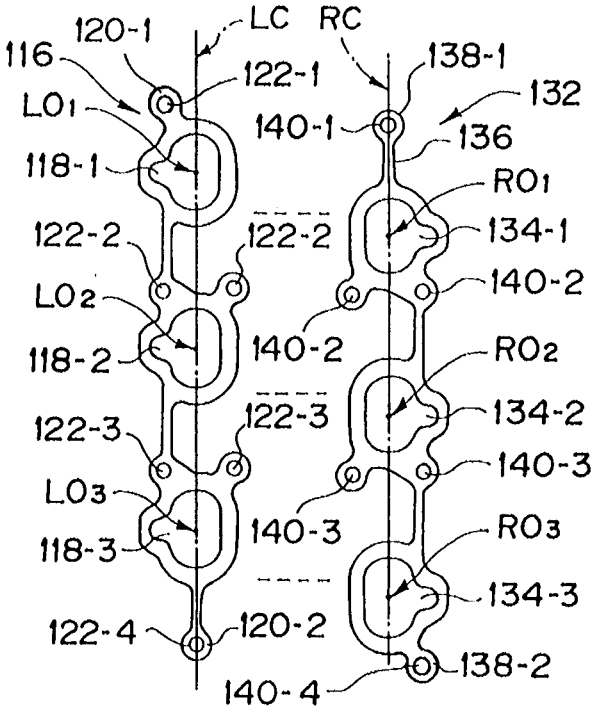
FIG. 9 PRIOR ART

In the present invention, modifications as described below can be made in accordance with the shape of any component such as a throttle body 58 mounted on the intake manifolds 28 and 42, the shape of the thermo-case 64, the shapes of the delivery fuel pipes 66 and 68, and the like. That is, as shown in FIG. 5, only the primary side flange end portions 36-1 and 36-2 may be disposed in the outward direction of the engine 2 with respect to the centerline LC. Alternatively, as illustrated in FIG. 6, only the secondary side flange end portions 52-1 and 52-2 may be located in the outward direction of the engine 2 in relation to the centerline RC. As a results, any component to be disposed within the bank space 22 of the engine 2 can be laid out with a greater amount of freedom.

In conclusion, according to the present invention, each of the flange end portions 36 of the primary side flange 34 is secured to the primary side cylinder head 10 by respective ones of the primary side fasteners 38. In addition, each of the flange end portions 52 of the secondary side flange 48 is fastened to the secondary side cylinder head 12 by respective ones of the secondary side fasteners 54. The fasteners 38 and 54 for respectively tightening the flange end portions 36 and 52 can be located in the outward direction on at least one side of the engine 2 in relation to the respective port entrance centerline, which centerline interconnects the centers of the port entrance portions of one side (i.e. the primary or secondary side intake ports) of the engine. The intake ports are in respective communication with the primary and secondary side cylinders.

As evidenced by the above detailed description, according to the present invention, each of the flange end portions of the primary side manifold-mounting flange is tightened to the primary side cylinder head by respective ones of the primary side fasteners. In addition, each of the flange end portions of the secondary side manifold-mounting flange is fastened to the secondary side cylinder head by respective ones of the secondary side fasteners. Furthermore, at least one side of the primary and secondary side mounting flanges has the fasteners thereof for respectively securing the aforesaid flange end portions located in the outward sideward direction of the V-type engine with respect to the port entrance centerline, which interconnects the centers of the port entrance portions of one side of primary and secondary side intake ports. The intake ports are in respective communication with the primary and secondary side cylinders. This arrangement enables the primary and secondary side intake manifolds having a throttle body or the like assembled thereon to be built into the V-type engine without dividing the intake manifolds.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An air suction device for a V-type combustion engine having primary and secondary side engine banks formed by primary and secondary side cylinder heads placed respectively on primary and secondary side cylinder banks, said cylinder banks being upper portions of a V-shaped cylinder block and each said cylinder head having a number "N" of intake port entrance portions having centers interconnected by a port entrance centerline, in which a primary manifold-mounting flange for a primary side intake manifold is secured to said primary side cylinder head by at least N+1 primary side fasteners, said primary side intake manifold being provided with a plurality of primary side branch pipes for introducing inducted air into primary side cylinders of said primary side engine bank, and in which a secondary manifold-mounting flange for a secondary side intake manifold is secured to said secondary side cylinder head by at least N+1 secondary side fasteners, said secondary side intake manifold being provided with a plurality of secondary side branch pipes for introducing inducted air into secondary side cylinders of said secondary side engine bank, the improvement wherein each first and second end portion of said primary mounting flange is secured to said primary side cylinder head by a respective one of said primary side fasteners, wherein each first and second end portion of said secondary mounting flange is fastened to said secondary side cylinder head by a respective one of said secondary side fasteners, and wherein the fasteners for respectively tightening the respective first and second end portions of said primary and secondary mounting flanges are each disposed a spaced apart predetermined distance from said port entrance centerline in a sidewardly outward direction of said engine, said N+1 fasteners being disposed in a generally aligned relationship along a row which extends parallel to the respective port entrance centerline and is spaced sidewardly outwardly therefrom said predetermined distance.

2. A device according to claim 1, wherein each said mounting flange includes an intermediate portion disposed between said first and second end portions and having at least one of said N+1 fasteners associated therewith and disposed said predetermined distance sidewardly outwardly from said respective port entrance centerline, said intermediate portion having a further said fastener associated therewith and disposed in a sidewardly inwardly spaced relation on the opposite side of said entrance port centerline.

3. A device according to claim 2, wherein each said mounting flange has at least two of said intermediate portions disposed in said spaced relation between said first and second end portions, each said intermediate portion having one of said N+1 fasteners associated therewith in said sidewardly outward direction and also having a further said fastener associated therewith in said sidewardly inwardly spaced relation on the opposite side of said entrance port centerline, and wherein N equals at least 3.

4. An air suction device for a V-type combustion engine having primary and secondary side engine banks formed by primary and secondary side cylinder heads placed respectively on said primary and secondary side cylinder banks, said cylinder banks being upper portions of a V-shaped cylinder block and each said cylinder head having a number "N" of intake port entrance portions having centers interconnected by a port entrance centerline wherein N equals at least three, in which a primary manifold-mounting flange for a primary side intake manifold is secured to said primary side cylinder head by a plurality of primary side fasteners, said primary side intake manifold being provided with a plurality of primary side branch pipes for introducing inducted air into primary side cylinders of said primary side engine bank, and in which a secondary manifold-mounting flange for a secondary side intake manifold is secured to said secondary side cylinder head by a plurality of secondary side fasteners, said secondary side intake manifold being provided with a plurality of secondary side branch pipes for introducing inducted air into secondary side cylinders of said secondary side engine bank, the improvement wherein each of said primary and secondary side mounting flanges has a number "N" of intermediate portions which are disposed between first and second end portions and cooperate respectively with said intake port entrance portions, said fasteners including N+1 outer fasteners and at least N−1 inner fasteners, each said first and second end portion of said primary mounting flange being secured to said primary side cylinder head by a respective one of said N+1 outer fasteners, each said first and second end portion of said secondary mounting flange being fastened to said secondary side cylinder head by a respective one of said N+1 outer fasteners, and said N+1 outer fasteners being disposed in a generally aligned relationship along an outer row which extends parallel to the respective port entrance centerline and spaced a predetermined distance from said respective port entrance centerline in a sidewardly outward direction, said N−1 inner fasteners disposed in a sidewardly inwardly spaced relation on the opposite side of said respective entrance port centerline and disposed in a generally aligned relationship along an inner row which extends parallel to said respective entrance port centerline.

* * * * *